US007314999B2

(12) United States Patent
Dobler

(10) Patent No.: US 7,314,999 B2
(45) Date of Patent: Jan. 1, 2008

(54) ANTIKINK DEVICE FOR AN ELECTRICAL CABLE

(75) Inventor: Oliver Dobler, Tschagguns (AT)

(73) Assignee: Neutrik Aktiengesellschaft, Schaan (LI)

( * ) Notice: Subject to any disclaimer, the term of this patent is extended or adjusted under 35 U.S.C. 154(b) by 0 days.

(21) Appl. No.: 11/341,325

(22) Filed: Jan. 27, 2006

(65) Prior Publication Data

US 2006/0169473 A1 Aug. 3, 2006

(30) Foreign Application Priority Data

Feb. 3, 2005 (DE) ..... 10 2005 005 216

(51) Int. Cl.
*H01B 7/00* (2006.01)

(52) U.S. Cl. ..... 174/110 R; 174/113 R; 174/115; 174/117 R; 174/120 R; 439/585

(58) Field of Classification Search ..... 174/110 R, 174/113 R, 115, 117 R, 120 R; 439/585, 439/584

See application file for complete search history.

(56) References Cited

U.S. PATENT DOCUMENTS 5,414,218 A * 5/1995 Nathan ..... 174/151
5,563,376 A * 10/1996 Hansell et al. ..... 174/102 R
6,050,847 A 4/2000 Kawakami et al.
6,068,506 A 5/2000 Shen
6,146,197 A 11/2000 Holliday et al.
6,338,644 B1 1/2002 Fritzinger et al.

FOREIGN PATENT DOCUMENTS

DE 37 17 296 A1 12/1988
DE 43 03 737 A1 8/1994
DE 19754236 A1 7/1998
DE 19753154 A1 6/1999
DE 69625227 T2 4/2004
EP 0 063 536 A1 10/1982

* cited by examiner

*Primary Examiner*—Dhiru R. Patel
(74) *Attorney, Agent, or Firm*—Neal L. Slifkin

(57) ABSTRACT

An antikink device for an electrical cable (1) which is connected to an electrical device, in particular, an electrical connector, or an electrical appliance, and which exhibits electrical conductors (13, 14) and a cable sheath (16) that forms the outer insulation of the cable (1), is formed by an antikink segment (9) of the cable (1), over which the thickness (E) of the cable sheath (16) or the thickness (D) of an antikink layer (17) arranged within the cable sheath (16) increases in the direction toward the cable end (18) that lies nearer to the antikink segment (9).

26 Claims, 6 Drawing Sheets

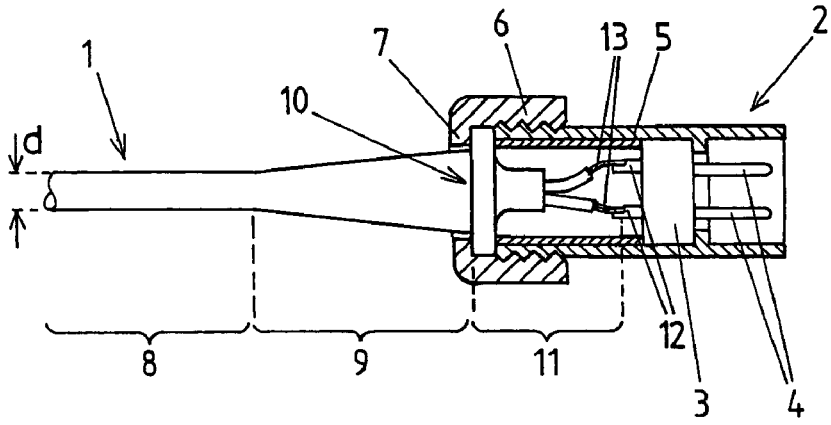
Fig. 1
Fig. 2
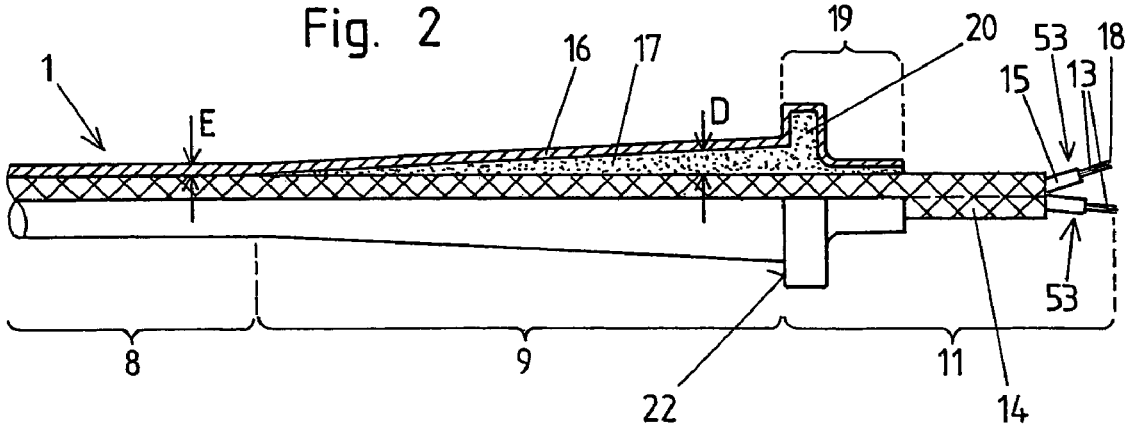
Fig. 3
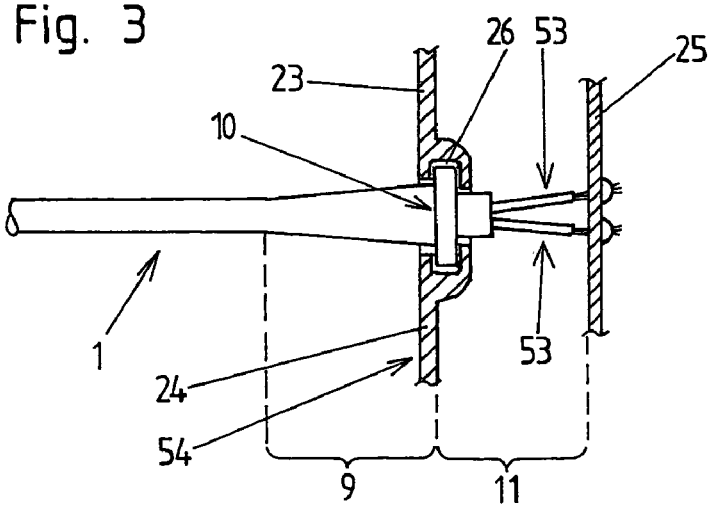

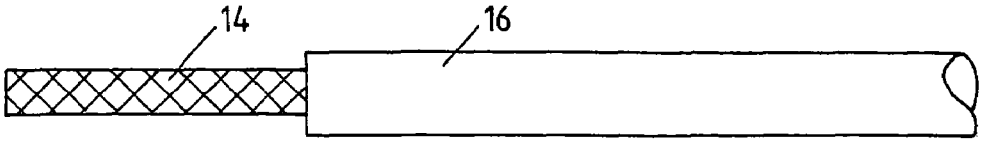
Fig. 6
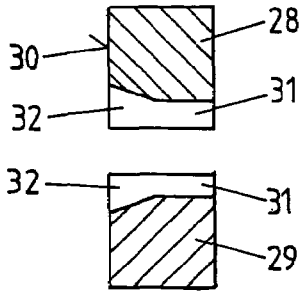
Fig. 7
Fig. 8
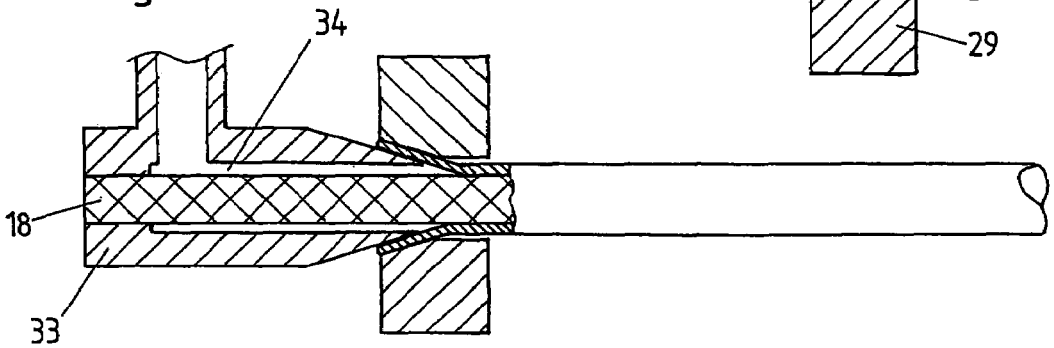
Fig. 9
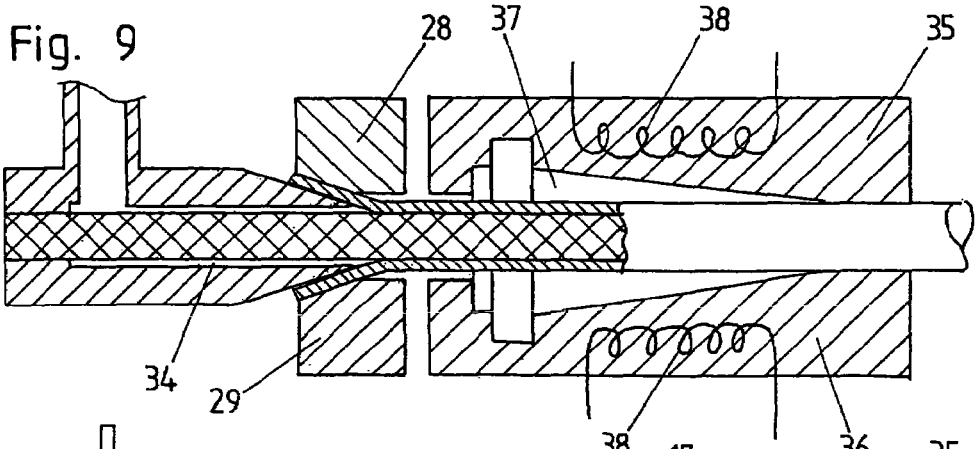
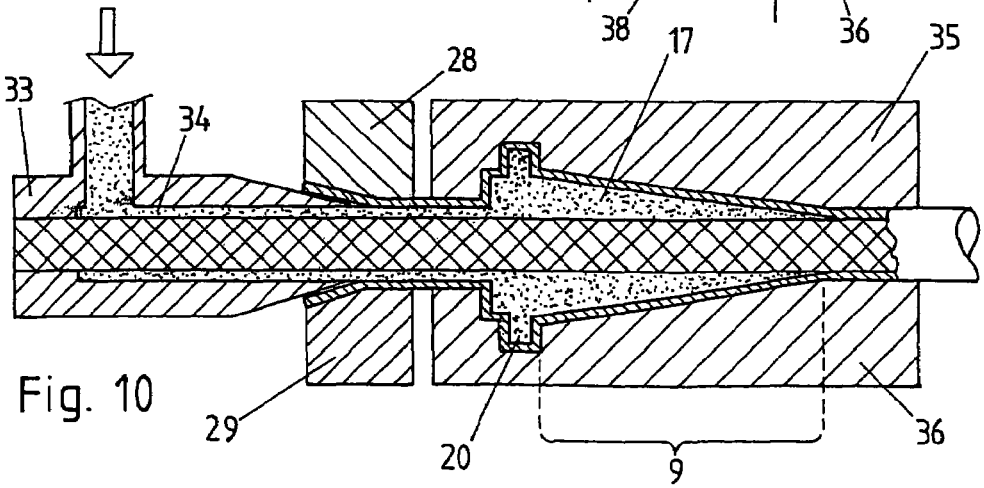
Fig. 10

ANTIKINK DEVICE FOR AN ELECTRICAL CABLE

BACKGROUND OF THE INVENTION a) Field of the Invention

The invention relates to an antikink device for an electrical cable which is connected to an electrical device, in particular, an electrical connector, or an electrical appliance, and which exhibits electrical conductors and a cable sheath that forms the outer insulation of the cable. The invention additionally relates to an electrical device, in particular, an electrical cable which is connected to an electrical connector or an electrical appliance and which exhibits electrical conductors and a cable sheath that forms the outer insulation of the cable, whereby the cable is mechanically and electrically connected with the electrical device in an installation segment which adjoins the cable end, and whereby an antikink device for the electrical cable is present. The invention additionally relates to an electrical cable which exhibits electrical conductors and a cable sheath that forms the outer insulation of the cable, and which can be mechanically and electrically connected with electrical devices in installation segments which adjoin the cable ends and which extend over a length of at least 0.5 cm, preferably at least 1 cm.

b) Description of the Related State of the Art

An antikink device for an electrical cable that protects the cable against kinking adjacent to the place at which the latter exits the housing of an electrical connector or an electrical appliance is known in the form of a so-called cable support sleeve (antikink bushing). This involves an elastic, tube-like part, usually undulating or ribbed, that is held on the housing and extends over the segment of cable that adjoins the housing. Already known as well are implementations in which the cable support sleeve is molded onto the cable sheath.

It is additionally known that an antikink device can be integrated inside an electrical connector, in that an end segment on the back of the connector housing through which the cable runs is designed elastically.

In the case of the above-mentioned conventional designs of the antikink protection, over the course of time there are nevertheless relatively frequent breaks of cable wires at the end of the elastic antikink part that surrounds the cable sheath. This is the location at which the cable is most severely strained by kinking stresses. Cable defects that originate in this way represent frequent causes for the failure of electrical appliances.

The introduction of a sealing compound into a cable end is already known in order to make a cable end liquid-tight, as is described, for example, in EP 477 022 A1 and JP 2003 174716 A. Known in addition from DE 43 03 737 A1 is a seating arrangement for a cable end piece to be able to absorb tension, transverse and torsional loads, whereby it involves in particular a cable with kink-sensitive fiber optic cables as signal lines. The seating arrangement exhibits a receptacle part that is slipped onto the end segment of the cable. Placed into the receptacle part is a sealing compound that also penetrates into the end segment of the cable. In addition, prior to that an expansion sleeve is pressed into the end of the cable thus expanding the cable sheath. When a cable that is provided with such a seating arrangement is mounted in a cable connector, then a separate, conventional antikink bushing is provided as antikink protection for the cable on the segment of the cable adjoining exit location of the cable connector from the housing, or else the antikink bushing is formed in one piece with the receptacle part.

SUMMARY OF THE INVENTION

One task of the invention is to provide an improved antikink device for an electrical cable, by means of which improved protection of the electrical cable against a break in the electrical wires of the cable is achieved.

According to the invention, this is accomplished by means of an antikink device for an electrical cable which is connected to an electrical device, in particular, an electrical connector or an electrical appliance, and which exhibits electrical conductors and a cable sheath that forms the outer insulation of the cable, whereby the antikink device is formed by an antikink segment of the cable, over which the thickness of the cable sheath or the thickness of an antikink layer arranged within the cable sheath increases in the direction toward the cable end that lies nearer to the antikink segment.

According to the invention, this is additionally accomplished by means of an electrical device, in particular, a cable that is connected to an electrical connector or an electrical appliance, including electrical conductors, a cable sheath that forms the outer insulation of the cable an installation segment which adjoins the cable end in which the cable is mechanically and electrically connected with the electrical device, and a free antikink segment for the cable, which adjoins the installation segment in the direction toward the middle of the cable, whereby the thickness of the cable sheath or the thickness of an antikink layer arranged within the cable sheath decreases with increasing distance from the end of the cable.

According to the invention, this is additionally accomplished by means of an electrical cable, including electrical conductors, a cable sheath that forms the outer insulation of the cable, installation segments which adjoin the cable ends, each of which extends over a length of at least 0.5 cm, in which it can be mechanically and electrically connected with electrical devices, at least one antikink segment for forming an antikink protection for the cable, which adjoins the installation segment in the direction toward the middle of the cable and extends over a length of at least 1 cm, and a middle segment that adjoins the antikink segment toward the middle of the cable, whereby the thickness of the cable decreases, from an initial value at the end of the antikink segment that faces toward the adjacent cable end, to a final value which is present at the end of the antikink segment that faces away from the adjacent cable end and which corresponds to the thickness of the cable in the middle segment of the cable, whereby in the antikink segment the thickness of the cable sheath or the thickness of an antikink layer arranged within the cable sheath decreases from the end of the antikink segment that faces toward the adjacent cable end, to the end of the antikink segment that faces away from the adjacent cable end.

Through the invention, the antikink device is thus integrated into the electrical cable, whereby in an antikink segment of the cable the thickness of the cable sheath or an antikink layer arranged within the cable sheath increases toward the nearer (=adjacent) cable end. The antikink segment of the cable that is connected to an electrical device adjoins toward the middle of the cable at an installation segment on the end of the cable in which the latter is mechanically and electrically connected with the electrical device.

In an advantageous embodiment of the invention, the thickness of the cable sheath or the antikink layer essentially increases continuously over the antikink segment in the direction toward the adjacent cable end. As a result, the bending radius of the cable for a specific bending force acting on the cable increases continuously over the antikink segment in the direction toward the adjacent cable end. In particular, the increase in the thickness of the cable sheath or the antikink layer over the antikink segment can be constant. This thus results in an overall conical (pyramidal) thickening of the cable over the antikink segment.

Through a design according to the invention, the forces acting upon the cable in the event of a bending stress can be distributed more uniformly, which results in the electrical conductors of the cable being better protected against a break.

In the embodiment of the invention in which an antikink layer with thickness that increases over the antikink segment toward the adjacent cable end is arranged within the cable sheath, this antikink layer advantageously also extends over a sub-segment, of an installation segment of the cable, that adjoins the antikink segment, and specifically, seamlessly and continuously between the antikink segment and the sub-segment, whereby the installation segment adjoins the antikink segment in the direction toward the adjacent cable end and is used for the mechanical and electrical connection to the electrical device. More beneficially in this regard, the antikink layer can exhibit a jump in thickness from a smaller thickness to a greater thickness in the region of this sub-segment to form a cable shoulder that points away from the cable end, whereby this shoulder that points away from the cable end can interact with a limit stop of the electrical device in order to form a cable strain relief. A simply designed and quickly installed cable strain relief device can be made available in this way.

In the embodiment of the invention in which the thickness of the cable sheath itself increases in size over the antikink segment in the direction toward the adjacent cable end, this increase in thickness advantageously also continues over an installation segment sub-segment that adjoins the antikink segment in the direction toward the adjacent cable end, whereby the installation segment is used for the mechanical and electrical connection to the electrical device. This cable installation segment sub-segment that increases in thickness can be gripped by holding parts of the electrical device that exhibit contact surfaces that are designed to correspond to the course of the cable sheath (and are thus at an angle or diagonal to the longitudinal axis of the cable), as a result of which a strain relief device can again be made available.

When this document refers to the "nearer" or "adjacent" cable end, it always means the end of the cable in whose proximity the particular mentioned antikink segment lies (i.e., the distance to this cable end is less than the distance to the other cable end). An antikink device designed in a manner in accordance with the invention can be present in one end region of the cable or in both end regions of the cable.

Additional advantages and details of the invention are explained in the following with the aid of the accompanying drawing, from which additional tasks of the invention emerge as well.

DESCRIPTION OF THE DRAWINGS

The following are shown in the drawing:

FIG. 1, a schematic representation of an embodiment of a cable installed on an electrical connector and having an antikink device according to the invention, whereby the housing of the electrical connector is shown in longitudinal section;

FIG. 2, a cable for forming an antikink device according to the invention, whereby the upper half of the cable except for the cable shield is shown in a section view;

FIG. 3, a schematic representation of an electrical cable connected to an electrical device and having an antikink device according to the invention, whereby only one segment of the housing and electrical circuit board of the electrical appliance are shown in a section view;

FIG. 6, a first manufacturing step for production of a cable for forming an antikink device according to the invention;

FIG. 7, a schematic section representation of holding cheeks for holding the cable at the end of the cable sheath;

FIG. 8, the cable gripped by the holding cheeks and an injection nozzle inserted into the end of the cable sheath;

FIG. 9, the parts from FIG. 8, whereby the cable is additionally placed into a form;

FIG. 10, the parts from FIG. 9 during the injection of plastic;

DESCRIPTION OF PREFERRED EMBODIMENTS

Figure 4:
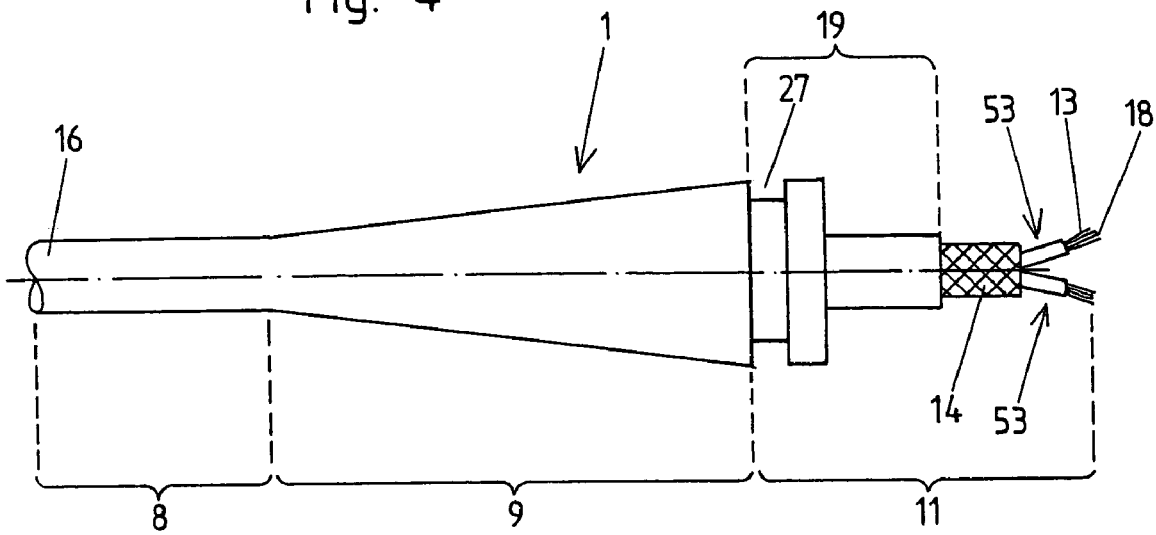
FIG. 4, an additional embodiment of a cable for forming an antikink device according to the invention.

FIG. 1 shows a first embodiment of the invention in schematic form. A cable 1, of which only one end is shown in FIG. 1, is connected to an electrical device, here in the form of an electrical connector 2, i.e., it is mechanically and electrically connected to the electrical device. The electrical connector 2, which is shown in FIG. 1 by way of an example, exhibits electrical plug contacts 4 that are supported by an insert part 3. The housing of the electrical connector that seats the insert part 3 is formed in two parts and includes the housing front part 5 and the rear housing part 6, which is screwed by its internal screw thread onto an external screw thread on the back end of the housing front part 5. The base 7 of the rear housing part 6 exhibits an entry opening for the cable 1 through which the cable 1 is fed into the housing of the electrical connector 2.

The cable 1 exhibits a constant outside diameter d over most of its length. Only a small part of this segment 8 of the cable is shown in FIG. 1. Adjoining segment 8 in the direction toward the cable end (at least in one end region of the cable) is an antikink segment 9, over which the thickness d of the cable (=its outside diameter) increases in the direction toward the adjacent cable end. This antikink segment 9 extends to the location at which a mechanical connection of the cable is made with the electrical device, i.e., with the electrical connector 2 in the embodiment shown.

It then adjoins the installation segment 11, which extends from the beginning of the mechanical connection of the cable with the electrical device to the end of the cable. An electrical connection of the cable with the electrical device also takes place in the installation segment 11.

The antikink segment 9 of the cable 1 thus lies outside the electrical device, i.e., it is free, whereby the antikink segment 9 adjoins the installation segment 11 that is connected to the electrical appliance.

In the embodiment shown, a mechanical connection of the cable 1 in its installation segment 11 with the electrical connector 2 is formed by means of the cable's ring collar 10, which is clamped between the back end of the housing front part 5 and the base 7 of the rear housing part 6. The electrical connection with the connector takes place by means of the connection parts 12, which are connected with the electrical plug contacts 4 and to which electrical conductors 13 of the cable are, for example, soldered. Crimp connections or screw connections, for example, are also conceivable and possible.

The design of the antikink segment 9 and the installation segment 11 of the cable are explained in more detail below with the aid of FIG. 2. The cable shown in FIG. 2 exhibits electrical conductors 13, each of which is surrounded by an inner insulation 15. The electrical conductors 13 can be designed as stranded connectors, for example. The two wires 53 that are each formed by an electrical conductor 13 and the insulation 15 surrounding the electrical conductor 13 are surrounded by a shielding conductor 14 (tracers or other parts can also be fed inside the shielding conductor 14). The outer insulation of the cable is formed by the cable sheath 16.

Also extending at least over the length of the antikink segment 9 over which the antikink device extends in the case of a cable connected to an electrical device is an antikink layer 17 that is arranged directly inside the cable sheath 16 (i.e., it borders its inside surface). The thickness D of the antikink layer 17 increases over the antikink segment 9 in the direction toward the adjacent cable end 18. Preferably, this increase is continuous so that in the event of a given bending force acting upon the cable, the bending radius of the cable increases continuously over the antikink segment 9 in the direction toward the cable end 18. If the antikink layer 17 in a different embodiment were to be designed with an undulation such that an essentially continuous increase of the bending radius still results over the antikink segment 9 in the direction toward the cable end 18, then it would still have to be viewed as an essentially continuous increase in the thickness of the antikink layer 17.

In the embodiment shown, the increase in the thickness D of the antikink layer 17 is constant over the antikink section 9, as a result of which a wedge-shaped design of the antikink layer 17 over the antikink segment 9 results.

The place at which antikink layer 17 ends at the end away from the cable end 18 represents the end of the antikink segment 9 that is away from the adjacent cable end 18. The thickness E of the cable sheath 16 is constant over the segment 8 of the cable that adjoins toward the middle of the cable.

During production of the antikink segment 9, there can be a decrease in the thickness E of the cable sheath 16 over the antikink segment 9 when compared with the cable segment 8 that adjoins toward the middle of the cable, whereby this decrease in the thickness E of the cable sheath becomes more pronounced the more the cable sheath is widened. For example, the thickness E of the cable sheath 16 in the region of its greatest widening can decrease to about half of the original thickness E (which is present in segment 8 of the cable). However, this decrease in the thickness E of the cable sheath in the direction toward the cable end lying nearer the antikink segment 9 is significantly smaller than the increase in the thickness D of the antikink layer 17 arranged within the cable sheath, so that the thickness d of the cable increases over the antikink segment 9 in the direction toward the adjacent cable end 18, preferably continuously. In the embodiment shown, the increase in the thickness d of the cable is constant over the antikink segment 9, as a result of which a conical design (=a tapered shape) of the cable in the antikink segment 9 results.

In the embodiment shown, the antikink layer 17 extends beyond the end of the antikink segment 9 facing the cable end 18, over a sub-segment 19 of the installation segment 11 of the cable. In this sub-segment 19, the antikink layer 17 forms a ring collar 20, which protrudes outward and the side flanks of which are essentially at a right angle to the longitudinal axis 21 of the cable. The cable sheath 16 follows the outer contour of the antikink layer 17. Thus formed as a result of the jump in thickness of the antikink layer 17 at the side flank of the ring collar 20 that is away from the cable end 18 is a ring collar 10 of the cable 1, which exhibits a shoulder 22 that points away from the adjacent cable end 18. This shoulder can interact with a limit stop of the electrical device on which the cable is mounted in order to form a cable strain relief. For example, in the case of an electrical connector 2 according to FIG. 1, this limit stop is formed by the inner wall of the base 7.

The cable shown in FIG. 2 can, for example be installed in an electrical connector, as is shown schematically in FIG. 1, for example. In this regard, for the sake of clarity the shielding conductor 14 has been left out in the embodiment of FIG. 1.

However, the invention is not limited to shielded cable. Thus, the antikink layer 17 could, for example, also be arranged between the outer cable sheath 16 and a foil layer that surrounds the wires of the cable. So-called double-sheath cables are also known, which exhibit, in addition to the outer cable sheath, an inner sheath layer that lies inside same. In this case, the antikink layer could be inserted between the two sheath layers.

If the cable is shielded, as is shown in FIG. 2, the part of the shielding conductor 14 that projects beyond the end of the cable sheath 16 can be connected to a shielding contact of an electrical connector, for example.

A cable for forming an antikink device according to the invention can be made with one, two, or more wires.

FIG. 3 shows in schematic form the connection of a cable according to the invention to an electrical appliance 54, of which only one segment of the housing 23, 24 and a circuit board 25 is shown in FIG. 3. Again, for the sake of clarity the shielding conductor has not been included in the drawing of the cable shown in FIG. 3, but it can be present. By way of example, the electrical conductors 13 are soldered to the circuit board 25. To seat a strain relief on the cable, the ring collar 10 of the cable, which is formed by the ring collar 20 of the antikink layer 17 covered by the cable sheath 16, is seated in a ring groove 26 formed by two housing parts 23, 24. The antikink segment 9 which adjoins the installation segment 11 in which the mechanical and electrical connection of the cable 1 with the electrical device takes place, is formed in the way described earlier with the aid of FIG. 2, as a result of which the antikink device for the cable is formed.

FIG. 4 shows an additional possible embodiment variant of a cable 1 for forming an antikink device in accordance with the invention. The antikink segment 9 is designed in the same way as was already described with the aid of FIG. 2. The antikink layer, which is not visible in FIG. 4, again also extends over an installation segment 11 sub-segment 19 that adjoins the antikink segment 9, whereby the installation segment 11 again represents the segment of the cable 1 which runs from the end of the antikink segment 9 facing the cable end 18 to the cable end 18 and in which the mechanical and electrical connection of the cable to the electrical device takes place. Starting from the end of the antikink segment 9, the antikink layer 17 possesses at first a thickness jump to a smaller thickness and then, after a section with constant thickness, a thickness jump back to the greater thickness that is present at the end of the antikink segment 9 facing the cable end 18. As a result of this last thickness jump, a shoulder 22 is formed, which faces away from the cable end 18 and which can interact with a corresponding limit stop of an electrical device on which the cable is mounted in order to form a strain relief. Overall, as a result of the thickness jumps of the antikink layer that the cable sheath 16 follows, a ring groove 27 that surrounds the cable is formed.

Figure 5:
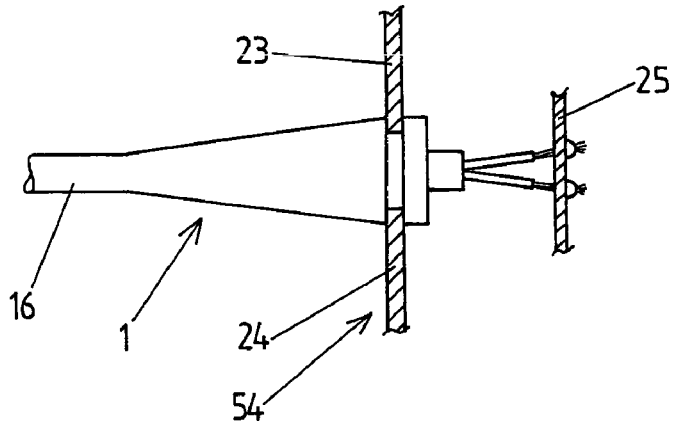
FIG. 5, an additional embodiment of the invention.

A possible installation situation in an electrical appliance 54 is shown in FIG. 5. The ring groove 27 is seated by an opening between the housing parts 23, 24, whereby it overlaps the edges of this opening on both sides. The electrical conductors 13 of the cable can again be soldered to a circuit board 25, for example.

A production method for producing cables with antikink segments that are configured in the way described is explained in the following with the aid of FIGS. 6 through 10.

Shown in FIG. 6 is an end segment of the cable, whereby an end piece of the cable sheath 16 has been removed so that the shielding conductor 14 of the cable is exposed over this region.

At the end of the cable sheath 16, the cable is then laid between holding cheeks 28, 29 as is shown schematically in FIG. 7 in the disassembled state. The holding cheeks 28, 29 exhibit on their sides facing each other half-shell-like recesses that are expanded in conical fashion toward the fronts 30 of the holding cheeks 28, 29. When brought together, these conically expanded regions form a cone shape. In the region of the end of the cable sheath 16, the cable 1 is laid between the holding cheeks 28, 29 as is shown in FIG. 8, whereby the widened regions 32 of the recesses 31 of the holding cheeks 28, 29 are facing the cable end 18.

An injection nozzle 33 with an internal through-channel is then inserted from the direction of cable end 18 onto the exposed segment of the shielding conductor 14. A part of the inner through-channel forms an injection channel 34, the inner wall of which surrounds the shielding conductor 14 at a distance. Toward cable end 18, the other part of the inner through-channel of the injection nozzle 33 lies tightly against the shielding conductor 14 (for example, its diameter can be decreased at least in segments after it has been inserted onto the shielding conductor). The end of the injection nozzle 33 facing the cable sheath 16 is configured so it comes together in pointed fashion in the manner of a cup point, so that this end can be run between the cable sheath 16 and the shielding conductor 14, and when this is done the cable sheath 16 spreads outward and presses against the walls of the widened regions 32 of the recesses 31 in the holding cheeks 28, 29. These walls of the widened regions 32 form, first, clamping surfaces for clamping the cable sheath 16 between the insertion end of the injection nozzle 33 and the holding cheeks 28, 29 which results in the cable being fixed in place, and second, counterpressure surfaces in order to achieve a seal between the insertion end of the injection nozzle 33 and the cable sheath 16.

A mold that is formed by the mold halves 35, 36 is then closed around the cable, and specifically, in a segment adjoining the holding cheeks 28, 29 on the end of the cable 1 that is away from the adjacent cable end 18. The walls of the mold cavity 37 formed by the mold halves 35, 36 exhibit the desired outer contour of the cable in this segment of the cable when it is finished.

The mold halves 35, 36 are heated, whereby heating coils 38 are indicated schematically in FIG. 9. When this is done, the cable sheath 16 is brought to a temperature such that it possesses sufficient elasticity for its subsequent widening. For this purpose, the cable sheath 16 is made of a suitable thermoplastic. Cable sheaths are frequently made of PVC. In that case, for example, heating to approximately 80° C. can be appropriate. The cable sheath 16 can also be made of other thermoplastics, e.g., PUR.

A suitable plastic material is then injected through the injection nozzle 33, preferably a thermoplastic, e.g., PVC, or a thermoplastic elastomer. The plastic material passes through the injection channel 34 into the interior of the cable sheath 16 and presses the latter outward against the walls of the recesses 31 in the holding cheeks 28, 29 (from which it was previously still at a distance). The plastic material thus passes between the cable sheath 16 and the shielding conductor 14 further into the interior of the cable, whereby it continuously widens the cable sheath. Between the entry regions into the mold halves 35, 36, the cable sheath can then first be widened only slightly until it lies against the walls of the mold halves 35, 36 in these entry regions. This is followed by the widened mold cavity into which the plastic material flows under a successive widening of the cable sheath 16 until the latter lies against the walls of the mold halves 35, 36. At the opposite end of the mold, the mold halves 35, 36 surround the cable sheath 16 with no play right from the beginning, so that at this location the cable is sealed against any further penetration of plastic material.

The mold cavity 37 is designed in such a way that, over a segment that represents the antikink segment 9 in the finished cable when it is connected to an electrical device, the thickness of the injected plastic material that forms the antikink layer 17 increases continuously in the direction toward the cable end 18. In this embodiment of the mold halves 35, 36, an outward protruding ring collar 20 of the antikink layer 17 is formed in the direction toward the cable end 18 adjoining the antikink segment 9.

The described production of a cable with an antikink layer in the interior of the cable sheath is not limited to a shielded cable. Other cables in which the cable sheath can be lifted from the region of the cable that lies radially within the cable, e.g., double-sheath cables or cables, in which the cable wires are wrapped with a foil, are suitable as well.

It would also be conceivable and possible to perform a preliminary spreading of the cable sheath in the front end segment of the cable sheath by means of a spreading cone prior to the insertion of the injection nozzle.

Another possible embodiment of an antikink device in accordance with the invention and the production of a cable for forming same are explained in the following with the aid of FIGS. 11 through 13 and 16 through 19.

In this cable, the antikink segment is formed by a thickening of the cable sheath itself. For this purpose, during production in the region in which the one cable is to end and another is to begin, the thickness (E) of the cable sheath is first increased in size (over the length a in FIG. 11), then held constant (over the length b in FIG. 11), and then reduced in size to the original value again (over the length c in FIG. 11).

Figure 11:
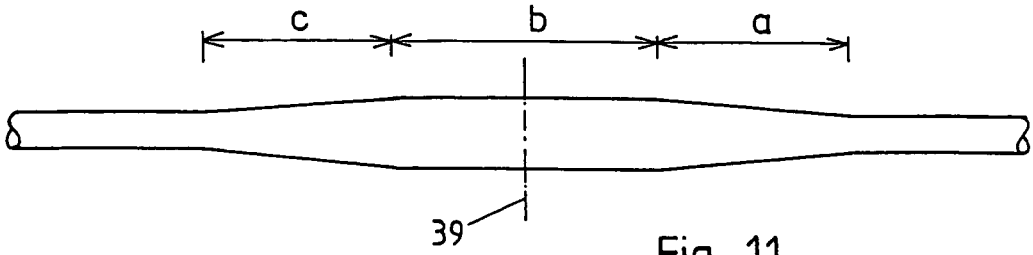
FIG. 11, a side view of a cable for forming an antikink device according to the invention in accordance with an additional embodiment of the invention, during the manufacturing process for the cable.
Figure 12:
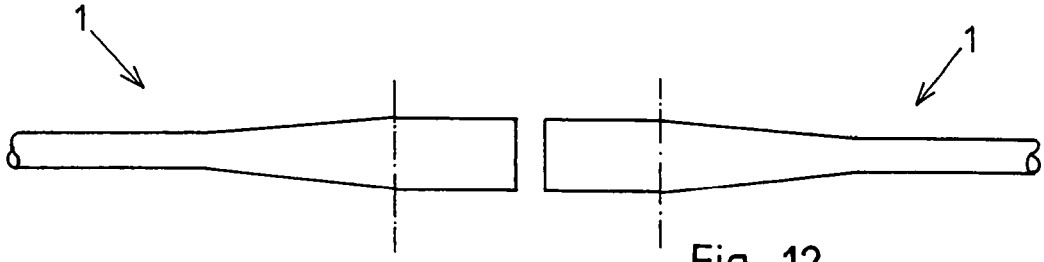
FIG. 12, an additional production step of the cable from FIG. 11.
Figure 13:
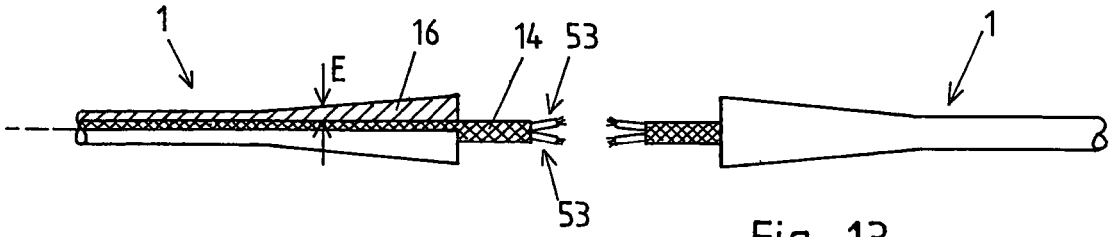
FIG. 13, end regions of two finished cables, whereby the upper half of the left cable except for the cable sheath is shown in a section view.

The strand that is formed is then cut through (FIG. 12) in the middle of length b at the line 39 shown in FIG. 11. The cable sheaths are then removed in end segments of the two cables 1, as a result of which, for example, the shielding conductor 14 lying underneath that is exposed. One end piece of this is removed from each in order to expose the wires, from which the insulation is stripped at the ends in order to expose the electrical conductors 12 (FIG. 13).

Figure 14:
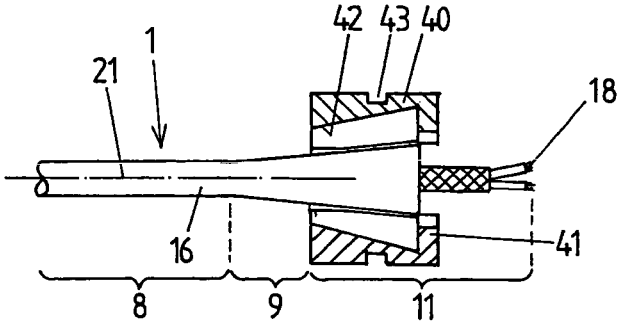
FIG. 14, the end region of the cable with holding parts, shown in a schematic section view, that are to be placed on the cable.

In order to install a cable that has been prepared in this way into an electrical device, holding parts 40, 41 of the electrical device that have, for example, a shell-like shape, are placed on the end segments of the cable sheath as is shown in FIG. 14. The holding parts 40, 41 exhibit inner surfaces 42, which run diagonally to the longitudinal axis 21 of the cable when viewed in a longitudinal section, and which correspond to the outer contour of the cable sheath 16.

Figure 15:
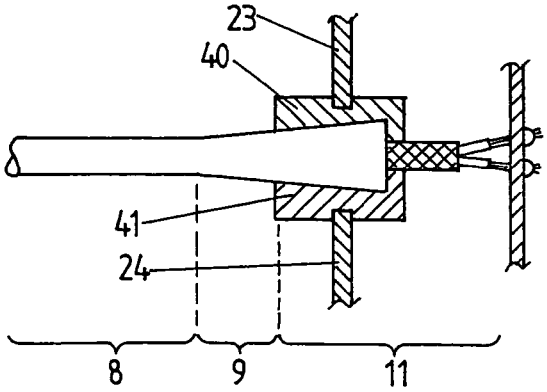
FIG. 15, a schematic representation of the cable mounted in an electrical appliance, whereby other than the holding parts, only one segment of the housing and a circuit board of the electrical appliance are shown in a section view, FIG. 16, a schematic oblique view of an extrusion die for production of a cable according to FIGS. 11 through 15.
Figure 16:
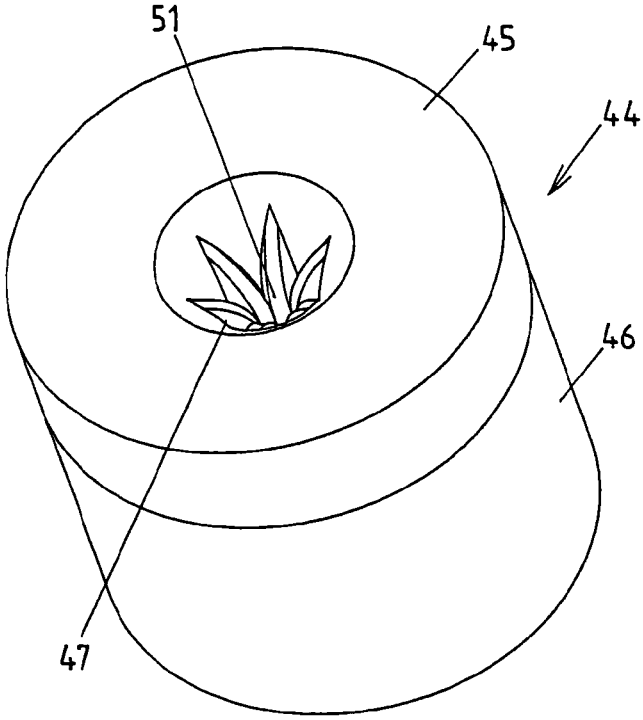
Figure 18:
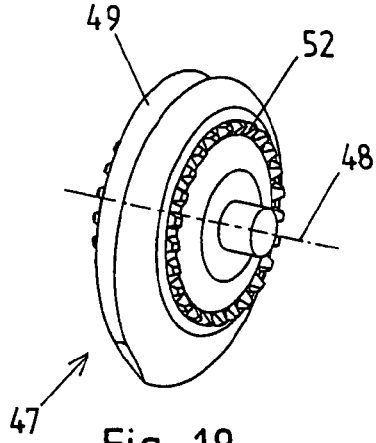
FIG. 18, an oblique view of an adjustable wheel that delimits the die opening.

In the embodiment shown, each of the holding parts 40, 41 exhibits on its outside half of a ring groove 43, whereby when the holding parts 40, 41 are placed on the cable, in sum a surrounding ring groove 43 is formed. The circular arc-shaped edges of the housing parts 23, 24 are placed into this ring groove, as can be seen in FIG. 15. The electrical conductors 13 and possibly the shielded conductor 14 are connected to the electrical appliance. Shown schematically in FIG. 15 by way of example is a circuit board 25 to which the electrical conductors 13 are soldered. In the embodiment shown, the installation segment 11 of the cable 1 that is connected to the electrical appliance extends from the cable end 18 to the end, away from the cable end 18, of the holding parts 40, 41 that hold the cable sheath 16 in its end region. Adjoining in the direction that points away from the adjacent cable end 18 is the antikink segment 9, over which the thickness of the cable sheath decreases continuously with increasing distance from the adjacent cable end 18, until at the end of the antikink segment 9 that is away from the cable end 18, a final value is reached that remains constant over the remaining course of the cable (segment 8).

As a result of the cable sheath 16 thickness that increases continuously over the antikink segment 9 toward the cable end 18, there is a continuous increase in the bending radius of the cable over the antikink segment 9 in the direction toward the cable end 18 when a predetermined bending force acts upon the cable.

The cable with the holding parts 40, 41 that can be placed on the end of the cable sheath can be installed in a similar way in a different electrical device, for example, in an electrical connector. When this is done, the cable strain relief can be realized by means of the holding parts 40, 41. Instead of the half-shell-like holding parts 40, 41, gripping collets could also be used for cable strain relief, which can be designed in the same way as the gripping collets that are commonly known in connection with electrical connectors. The action of the gripping collet is improved even further as a result of the conical configuration of the end segment of the cable sheath 16.

FIGS. 16 through 19 show in schematic form a possible embodiment of an extrusion die 44 by means of which a relatively large change in the thickness of the cable sheath can be made during its extrusion. Rotatably supported between two die parts 45, 46 are wheels 47 having axes of rotation 48 that are arranged in a common plane. The wheels 47 exhibit at their circumferences groove-like depressions 49, the width and depth of which increase continuously along the circumference of the wheel 47, starting from a minimum initial value. In a section that runs parallel to the axis of rotation 48 and centrally through the wheel 47 (cf. FIG. 19), each depression 49 forms a segment of a circle.

Figure 19:
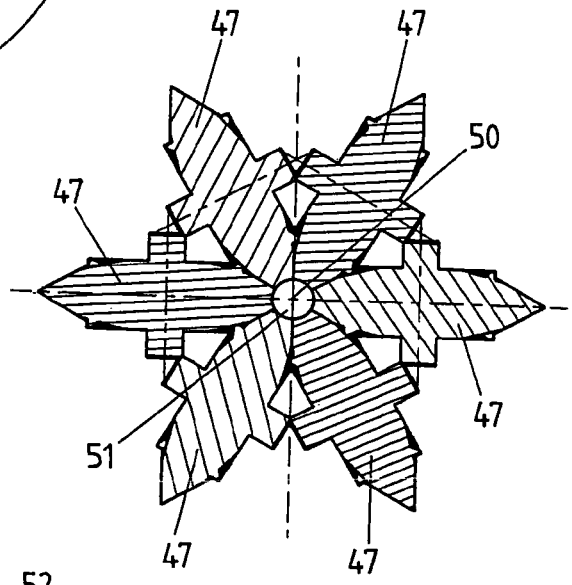
FIG. 19, a schematic cross section through the wheels that delimit the die opening, in the plane of their axes of rotation.
Figure 17:
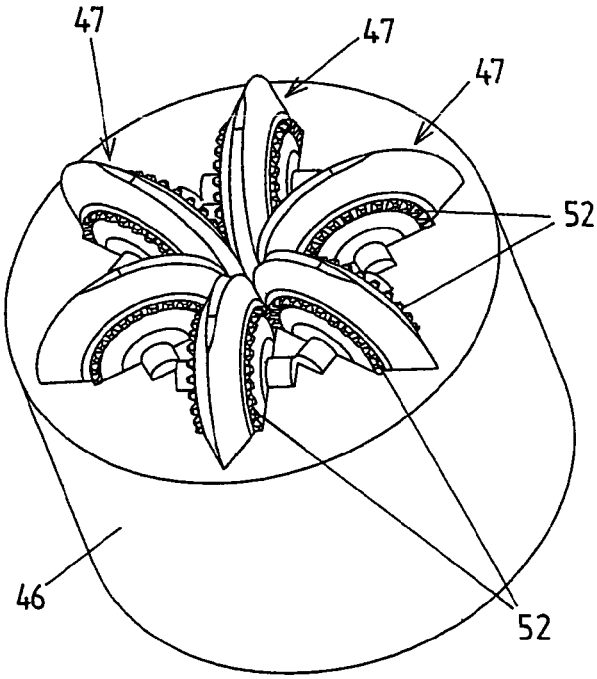
FIG. 17, an oblique view according to FIG. 16, but without the front part of the die.
Figure 20:
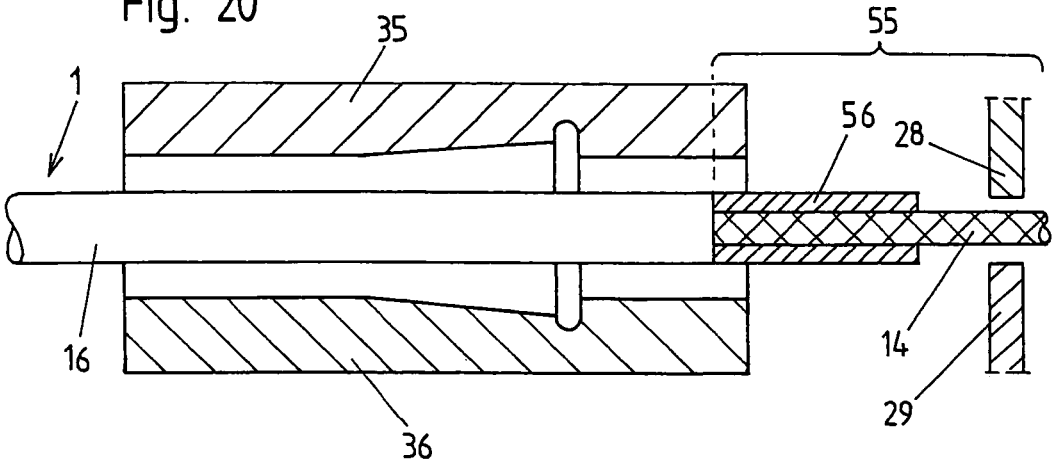
FIGS. 20 through 23, manufacturing steps for the production of a cable in accordance with an additional embodiment of the invention.

The wheels 47 are arranged radially around a central center axle 50, whereby in section through their axes of rotation according to FIG. 19 the individual circle segments at the circumferences of the wheels 47 combine to form a circular die opening 51. The diameter of this die opening 51 can be changed by means of the simultaneous rotation of the wheels 47 by the same angle of rotation. To couple the rotation of the wheels 47, the latter exhibit on their side surfaces toothing systems 52 that mesh with each other.

During production of the cable 1, the core of the cable 1 (=the finished parts of the cable without the cable sheath) are fed through the die opening 50 through which the plastic material that forms the cable sheath is extruded, whereby the thickness of the cable sheath can be changed through the simultaneous rotation of the wheels 47.

Another production method for forming an antikink segment is shown in FIGS. 20 through 23, and specifically, in schematic section representations analogous to FIGS. 6 through 10.

First, the cable sheath 16 is removed in an end segment 55 of the cable 1. The cable 1 is now shown as shielded cable, so that the shielding conductor 14 is visible after the cable sheath 16 has been removed. The method can also be used for other cables. A pressure ram 56 is applied to the end segment 55, pressed on from the direction of the cable end, for example. The pressure ram 56 could also be made in two parts, for example, and the two parts could then be placed radially on the circumference.

The cable 1 is placed into a mold with the two mold halves 35, 36, and the mold halves 35, 36 are closed. A mold cavity 37 is formed, which extends at least over the antikink segment 9 that is to be formed. In the embodiment shown, the mold cavity 37 also extends over a sub-segment of the segment adjoining the adjacent cable end 18 in order to form a strain relief device for the cable.

In addition, holding cheeks 28, 29 that hold the cable tightly are placed on the end segment 55 of the cable in a region that lies further toward the adjacent cable end 18 than the pressure ram 56.

The mold is then heated until the cable sheath 16 has reached a plastically deformable state.

Figure 21:
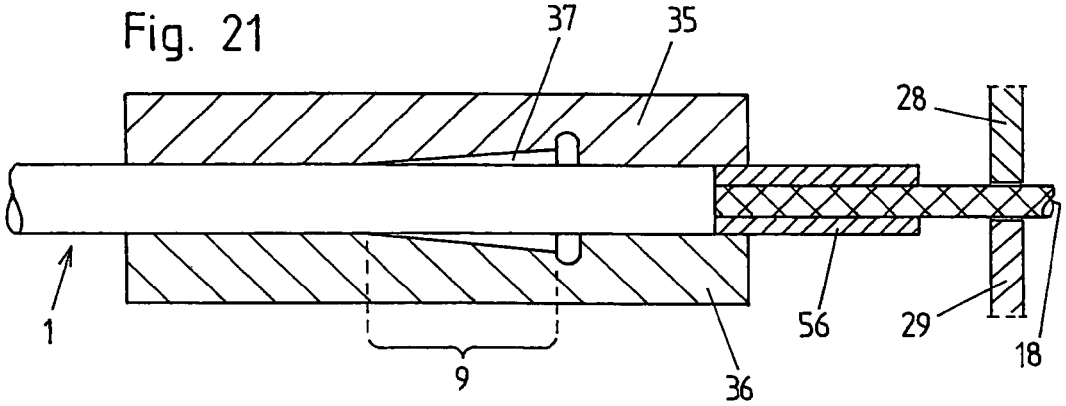
Figure 22:
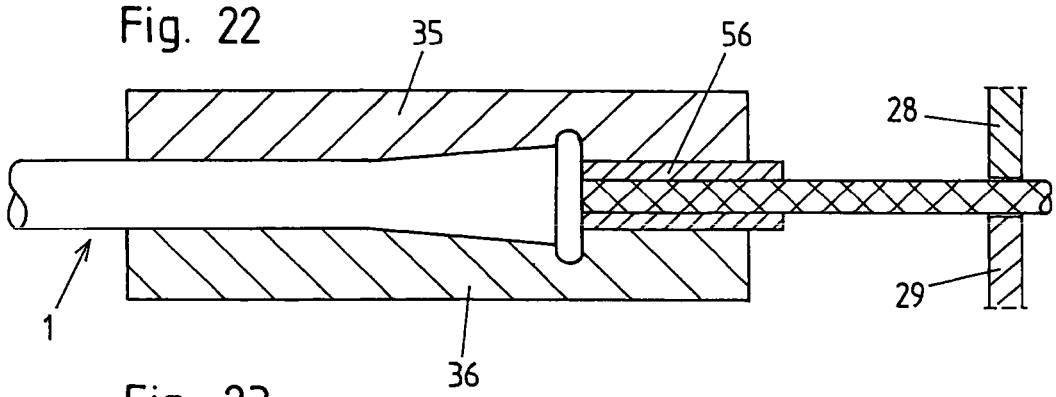
Figure 23:
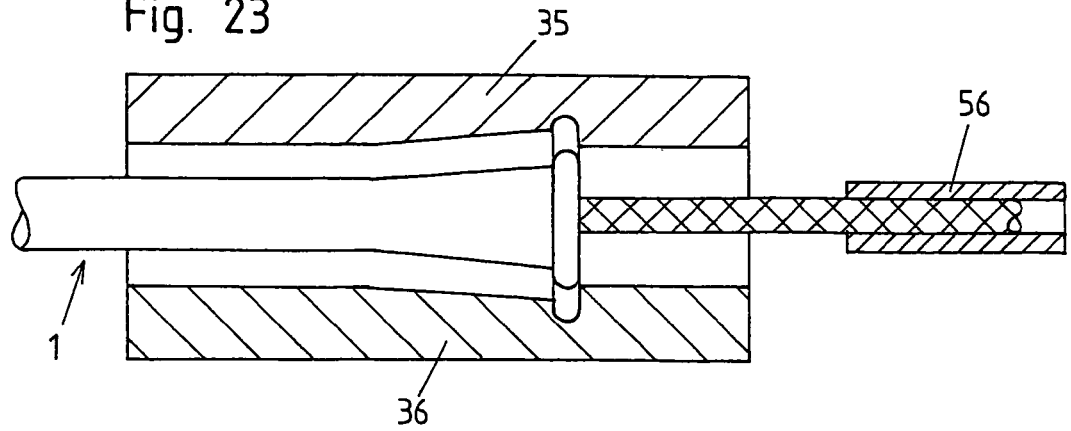

Starting from this state that is shown in FIG. 21, the pressure ram 56 is now pressed into the closed mold 35, 36 in the longitudinal direction of the cable 1. As a result, the plastically deformable cable sheath 16 is compressed and flows into the mold cavity 37 of the mold until the latter is completely filled and the cable has taken on the desired final form (FIG. 22).

Following a cooling phase, the holding cheeks 28, 29 are loosened and the pressure ram 56 is withdrawn. The mold halves 35, 36 are then opened and the finished cable 1 can be removed.

In the embodiment shown, the latter subsequently exhibits on the conically widening antikink segment 9 a ring collar (=a bead) 20 which protrudes radially outward and on which a holding part can engage in order to form a strain relief.

For all of the different embodiments of the cable, in each case the length of the antikink segment 9 of the cable is at least 1 cm, whereby a length of at least 1.5 cm is especially preferable. By doing this, this antikink segment length is at a distance from the cable end as a result of the length of an installation segment, whereby this length of the installation segment is preferably at least 0.5 cm and a value of 1 cm is especially preferred.

As emerges from the preceding description, the field of the invention is not limited to the embodiments shown, but should be determined by taking into account the appended claims along with its full range of possible equivalents.

While the foregoing description and the drawings illustrate the invention, it is obvious to the person skilled in the art that various changes can be made therein without abandoning the spirit and field of the invention.

LEGEND FOR REFERENCE NUMBERS

| | |
|---|---|
| 1 | Cable |
| 2 | Electrical connector |
| 3 | Insert part |
| 4 | Electrical plug contact |
| 5 | Housing front part |
| 6 | Housing part |
| 7 | Base |
| 8 | Segment |
| 9 | Antikink segment |
| 10 | Ring collar |
| 11 | Installation segment |
| 12 | Connection part |
| 13 | Electrical conductor |
| 14 | Shielding conductor |
| 15 | Insulation |
| 16 | Cable sheath |
| 17 | Antikink layer |
| 18 | Cable end |
| 19 | Sub-segment |
| 20 | Ring collar |
| 21 | Longitudinal axis |
| 22 | Shoulder |
| 23 | Housing part |
| 24 | Housing part |
| 25 | Circuit board |
| 26 | Ring groove |
| 27 | Ring groove |
| 28 | Holding cheek |
| 29 | Holding cheek |
| 30 | Front |
| 31 | Recess |
| 32 | Widened region |
| 33 | Injection nozzle |
| 34 | Injection channel |
| 35 | Mold half |
| 36 | Mold half |
| 37 | Mold cavity |
| 38 | Heating coil |
| 39 | Line |

-continued

| | |
|---|---|
| 40 | Holding part |
| 41 | Holding part |
| 42 | Inner surface |
| 43 | Ring groove |
| 44 | Extrusion die |
| 45 | Die part |
| 46 | Die part |
| 47 | Wheel |
| 48 | Axis of rotation |
| 49 | Depression |
| 50 | Center axle |
| 51 | Die opening |
| 52 | Toothing system |
| 53 | Wire |
| 54 | Electrical appliance |
| 55 | End segment |
| 56 | Pressure ram |

The invention claimed is:

1. An antikink device for an electrical cable (1) which is connected to an electrical device, in particular, an electrical connector, or an electrical appliance, and which exhibits electrical conductors (13, 14) and a cable sheath (16) that forms the outer insulation of the cable (1), wherein the antikink device is formed by an antikink segment (9) of the cable (1), over which the thickness (D) of an antikink layer (17) arranged within the cable sheath (16) increases in the direction toward the cable end (18) that lies nearer to the antikink segment (9).

2. The antikink device according to claim 1, wherein the increase in the thickness (D) of the antikink layer (17) arranged within the cable sheath (16) is essentially continuous over the antikink segment (9).

3. The antikink device according to claim 1, whereby the thickness (d) of the cable (1) increases continuously over the antikink segment (9) of the cable (1) in the direction toward the cable end (18) that lies nearer to the antikink segment (9).

4. The antikink device according to claim 1, whereby the antikink layer (17) ends at the end of the antikink segment (9) that faces away from the nearer cable end (18).

5. The antikink device according to claim 1, whereby an installation segment (11) of the cable (1) in which the cable (1) can be mechanically and electrically connected with the electrical device adjoins the antikink segment (9) in the direction toward the nearer cable end (18).

6. The antikink device according to claim 1, whereby the antikink layer is made of a thermoplastic plastic.

7. The antikink device according to claim 1, whereby the antikink layer (17) is arranged between the cable sheath (16) and a layer that surrounds the at least one electrical wire (53) of the cable.

8. An antikink device for an electrical cable which is connected to an electrical device, in particular, an electrical connector, or an electrical appliance, and which exhibits electrical conductors and a cable sheath that forms the outer insulation of the cable, whereby the antikink device is formed by an antikink segment (9) of the cable, over which the thickness of the cable sheath (16) increases in the direction toward the cable end (18) that lies nearer to the antikink segment, and the cable sheath (16) is made seamless and continuous over the antikink segment (9) of the cable (1) and over the segment (8) of the cable (1) adjoining toward the middle of the cable and wherein the segment (8) of the cable sheath (16) which does not form part of the antikink segment is longer than the antikink segment (9).

9. The antikink device according to claim 8, wherein an installation segment of the cable in which the cable can be mechanically and electrically connected with the electrical device adjoins the antikink segment in the direction toward the nearer cable end and the cable sheath (16) extends seamlessly and continuously over the antikink segment (9) and over at least an installation segment (11) sub-segment (19) that adjoins the antikink segment (9), whereby in this sub-segment (19) of the installation segment (11) the electrical device interacts with the cable (1) to form a cable strain relief device.

10. The antikink device according to claim 9, wherein the cable sheath extends seamlessly and continuously over the antikink segment and over at least an installation segment sub-segment that adjoins the antikink segment, whereby in this sub-segment of the installation segment the electrical device interacts with the cable to form a cable strain relief device and the antikink layer (17) extends seamlessly and continuously over the antikink segment (9) and over the sub-segment (19) that adjoins the antikink segment (9) (FIG. 2).

11. The antikink device according to claim 9, whereby the thickness (E) of the cable sheath (16) further increases continuously over the sub-segment (19) that adjoins the antikink segment (9).

12. A cable (1) connected to an electrical device, in particular, to an electrical connector (2) or an electrical appliance, including electrical conductors (13, 14), a cable sheath (16) that forms the outer insulation of the cable (1), an installation segment (11) which adjoins the cable end (18) and in which the cable is mechanically and electrically connected to the electrical device, and a free antikink segment (9) that adjoins the installation segment (11) in the direction toward the middle of the cable in order to form an antikink device for the cable, wherein the cable sheath extends seamlessly and continuously over the antikink segment of the cable and the segment of the cable that adjoins toward the middle of the cable and the thickness of the cable sheath (16) or an antikink layer (17) arranged within the cable sheath (16) in the antikink segment decreases with increasing distance from the cable end (18).

13. A cable connected to an electrical device according to claim 12, whereby the antikink layer (17) ends at the end of the antikink segment (9) that is away from the cable end (18).

14. A cable connected to an electrical device according to claim 12, whereby the thickness (E) of the cable sheath (16) at the end of the antikink segment (9) that is away from the cable end (18) has decreased to the value that is present in the segment (8) of the cable that adjoins toward the middle of the cable (FIG. 13).

15. A cable connected to an electrical device according to claim 12, whereby the cable sheath (16) extends seamlessly and continuously over the antikink segment (9) and over an installation segment (11) sub-segment (19) that adjoins the antikink segment (9).

16. A cable connected to an electrical device according to claim 15, whereby in order to form a strain relief for the electrical cable, the antikink layer (17) also extends over the sub-segment (19) and exhibits in sub-segment (19) a jump in thickness that forms a shoulder (22) of the cable that points away from the cable end (18), whereby the shoulder lies against a limit stop of the electrical device that absorbs the tensile force on the cable (FIGS. 1, 3 and 5).

17. A cable connected to an electrical device according to claim 15, whereby the thickness of the cable sheath (16) increases further over the sub-segment (19), and in order to form a strain relief for the cable, holding parts (40, 41), which have inner surfaces (42) shaped to correspond to the outer contour of the cable sheath and which are held on the electrical device are placed on the installation segment (11) of the cable (FIG. 15).

18. Electrical cable, including electrical conductors (13, 14), a cable sheath (16) that forms the outer insulation of the cable (1), installation segments (11) which adjoin the cable ends (18), each of which extends over a length of at least 0.5 cm, in which it can be mechanically and electrically connected with electrical devices, at least one antikink segment for forming an antikink protection for the cable, which adjoins the installation segment (11) in the direction toward the middle of the cable and extends over a length of at least 1 cm, and a middle segment (8) that adjoins the antikink segment (9) toward the middle of the cable, whereby the thickness (d) of the cable decreases, from an initial value at the end of the antikink segment that faces toward the adjacent cable end (18), to a final value which is present at the end of the antikink segment (9) that faces away from the adjacent cable end (18) and which corresponds to the thickness of the cable in the middle segment (8) of the cable, whereby in the antikink segment (9) the thickness (E) of the cable sheath (16) or the thickness (D) of an antikink layer (17) arranged within the cable sheath (16) decreases from the end of the antikink segment (9) that faces toward the adjacent cable end (18), to the end of the antikink segment (9) that faces away from the adjacent cable end (18).

19. Electrical cable according to claim 18, whereby in order to form a strain relief for the electrical cable, the antikink layer (17) also extends over the installation segment sub-segment (19) that adjoins the antikink segment (9), and exhibits in sub-segment (19) a jump in thickness that forms a shoulder (22) of the cable that points away from the cable end (18), whereby the shoulder (22) lies against a limit stop of the electrical device that absorbs the tensile force on the cable (FIGS. 1, 3 and 5).

20. Method for the production of an antikink device for an electrical cable, whereby the cable is placed between two mold halves (35, 36) which in the closed state form a mold cavity (37) that extends at least over an antikink segment (9) of the cable, and an injection nozzle (33) for injecting plastic material that forms the antikink layer (17) is inserted into the front of the cable immediately radially inside a sheath layer (16) of the cable and then a plastic material is injected through the injection nozzle.

21. Method according to claim 20, whereby the cable is held by means of holding cheeks (28, 29) that surround the cable sheath.

22. Method according to claim 21, whereby the holding cheeks (28, 29) exhibit a widening on the end facing the front of the cable, and the wall of the cable sheath is pressed against its wall by the injection nozzle (33) when the latter is inserted into the front end segment of the cable sheath.

23. Method according to claim 20, whereby the mold cavity lies in sealing fashion against the outside of the cable sheath (16) at the end that is away from the injection nozzle (33) in the longitudinal direction of the cable.

24. Method for the production of an antikink device for an electrical cable, which is connected to an electrical device and which exhibits electrical conductors and a cable sheath (16) that forms the outer insulation of the cable, wherein the antikink device is formed by an antikink segment of the cable (9), over which the thickness of the cable sheath increases in the direction toward the cable end (18) that lies nearer to the antikink segment, the method comprising the step of changing the thickness (E) of the cable sheath over the antikink segment (9) of the cable during its extrusion through an extrusion die with a variable diameter of its die opening (51).

25. Method for the production of an antikink device for an electrical cable, whereby a cable sheath (16) of the cable is removed in an end segment (55) of the cable (1), the cable is then placed between two mold halves (35, 36) that in the closed state form a mold cavity (37) that extends over at least an antikink segment (9) of the cable, the mold (35, 36) is then heated in order to bring the cable sheath into a plastically deformable state, and a pressure ram (56) that surrounds the cable (1) in the region of the end segment (55) of the cable (1) in which the cable sheath (16) has been removed is pressed into the mold (35, 36) in the axial direction of the cable (1), whereby the cable sheath (16) is compressed and flows into the mold cavity (37) and fills it.

26. Method according to claim 25, whereby during the pressing of the pressure ram (56) into the mold, in order to absorb a tensile force exerted by the pressure ram (56), the cable (1) is held firmly in a region of the end segment (55) that lies nearer to the adjacent cable end (18).

* * * * *